United States Patent [19]

Hiller et al.

[11] 3,952,781

[45] Apr. 27, 1976

[54] LIQUID DISPENSING AND VAPOR RECOVERY SYSTEM AND A VAPOR FLOW CONTROL UNIT USED THEREIN

[75] Inventors: Trueman W. Hiller; Klaus D. Jarr, both of Bettendorf, Iowa

[73] Assignee: Weil-McLain Company, Inc., Davenport, Iowa

[22] Filed: Jan. 27, 1975

[21] Appl. No.: 544,376

[52] U.S. Cl. ..... 141/46; 141/59; 222/318; 55/182; 55/189; 55/468

[51] Int. Cl.[2] ..... B67D 5/04

[58] Field of Search ..... 222/318; 141/7, 45–46, 141/52, 290, 301, 59; 220/85 VS, 85 VR; 55/182, 189, 468; 137/98, 117

[56] References Cited

UNITED STATES PATENTS

| | | | |
|---|---|---|---|
| 2,126,367 | 8/1938 | Clawson et al. | 220/85 VR |
| 2,401,124 | 5/1946 | Walker et al. | 141/290 X |
| 2,650,003 | 8/1953 | Coleman | 222/318 |
| 2,912,830 | 11/1959 | Coldren et al. | 62/50 |
| 2,919,834 | 1/1960 | Rugeley et al. | 222/318 X |
| 2,953,147 | 9/1960 | Hornback | 137/117 X |
| 3,572,365 | 3/1971 | White | 137/117 |
| 3,863,687 | 2/1975 | Alquist | 141/45 |

*Primary Examiner*—Stanley H. Tollberg
*Assistant Examiner*—Charles A. Marmor
*Attorney, Agent, or Firm*—Lane, Aitken, Dunner & Ziems

[57] ABSTRACT

A liquid dispensing and vapor recovery system and a vapor control unit used therein in which the control unit has a pair of inlets for receiving liquid, such as gasoline, from an underground storage tank and for receiving gasoline vapors from a vehicle tank during dispensing of the gasoline into the latter tank. A first passage is provided in the control unit for passing the gasoline from the storage tank to a hose connected to the vehicle tank, and an additional passage is provided in the control unit for diverting a portion of the gasoline. A valve is provided which controls the flow of gasoline through the additional passage in response to the flow of gasoline through the first passage and an injector nozzle is provided in the additional passage for drawing vapors from the vehicle tank and into the second passage for mixing with the gasoline before being discharged back to the storage tank.

13 Claims, 2 Drawing Figures

LIQUID DISPENSING AND VAPOR RECOVERY SYSTEM AND A VAPOR FLOW CONTROL UNIT USED THEREIN

BACKGROUND OF THE INVENTION

This invention relates to a liquid dispensing and vapor recovery system and control unit used therein and, more particularly, to such a system and unit in which liquid is dispensed from a storage tank to a receptacle while vapors from the receptacle are passed to the storage tank.

With the increased emphasis on preventing pollution of the atmosphere, recent attention has been directed to minimizing the introduction of gasoline vapors into the atmosphere from both permanent type underground storage tanks for the gasoline, and from the vehicles into which the gasoline is ultimately dispensed.

Gasoline vapors can easily be recovered from underground storage tanks by providing a separate vapor return line which connects the storage tank to the transport truck which periodically fills the tank. In this manner, the gasoline introduced into the tank from the transport truck will displace the vapors and force them through the vapor recovery line to the truck whereby they are ultimately disposed of either by burning or through compression - refrigeration systems.

However, it has been extremely difficult to devise a satisfactory vapor recovery system from the gasoline tanks of vehicles. For example, previous proposals have utilized what is commonly referred to as a balanced displacement system in which the gasoline entering the tank forces the vapors through a separate line to the storage tank. However, this system has been less than satisfactory for several reasons. For example, since the fluid in the vehicle tank becomes pressurized upon introduction of the gasoline, any type of leak in the interface between the dispensing nozzle and the vehicle tank, such as that caused by an improper seal between the nozzle and the tank, results in a leakage of the gasoline vapors into the atmosphere.

Although it has been suggested to use a vacuum pump or a blower to remove the vapors from the vehicle tanks, this type of installation is disadvantageous from several standpoints. For example, the pump or blower is relatively expensive and creates potential safety problems due to the fact that it is electrically operated. Also, the output from the pump or blower is passed directly into the storage tank which pressurizes the tank and therefore increases vapor losses from the tank through its vent pipe.

In copending U.S. patent application Ser. No. 400,555, filed by Kirk Fowler and Elmer M. Deters on Sept. 25, 1973, and assigned to the same assignee of the present invention, a gasoline dispensing and vapor recovery system is disclosed which overcomes the above-mentioned problems by providing an injector for establishing a reduced pressure zone in response to fluid flow from the storage tank to the vehicle receptacle, with the reduced pressure zone functioning to draw the vapors from the receptacle back to the tank. Although this design has proven to be satisfactory, it has a limited operational range and is therefore not readily adaptable to dispensing installations of varying capacity.

SUMMARY OF THE INVENTION

It is, therefore, an object of the present invention to provide a liquid dispensing and vapor recovery system and a control unit used therein in which liquid is dispensed from a storage tank to a receptacle while vapors in the receptacle are recovered and delivered back to the storage tank.

It is a further object of the present invention to provide a system and unit of the above type which can be used in installations of varying capacity with the control unit being of a relatively small size.

It is a further object of the present invention to provide a system and unit of the above type which is relatively simple in operation and relatively low in cost.

It is a more specific object of the present invention to provide a system and unit of the above type in which the control unit is connected in liquid and vapor lines extending between the storage tank and the receptacle and operates to draw the vapors from the receptacle back to the storage tank in proportion to the amount of liquid dispensed.

Toward the fulfillment of these and other objects, the unit of the present invention comprises a housing having first and second inlets for receiving liquid and vapor, respectively, and first and second outlets for discharging liquid and a mixture of liquid and vapor, respectively, first passage means in the housing connecting the liquid inlet and the liquid outlet, second passage means in the housing for diverting a portion of the liquid from the first passage means, the second passage means registering with the second outlet, means responsive to the flow of liquid through the first passage means for controlling the flow of liquid through the second passage means, and means responsive to the flow of liquid through the second passage means for drawing vapor through the second inlet and into the second passage means, the liquid and the vapor combining in the second passage means and discharging from the second outlet.

DESCRIPTION OF THE PREFERRED EMBODIMENTS

Figure 1:
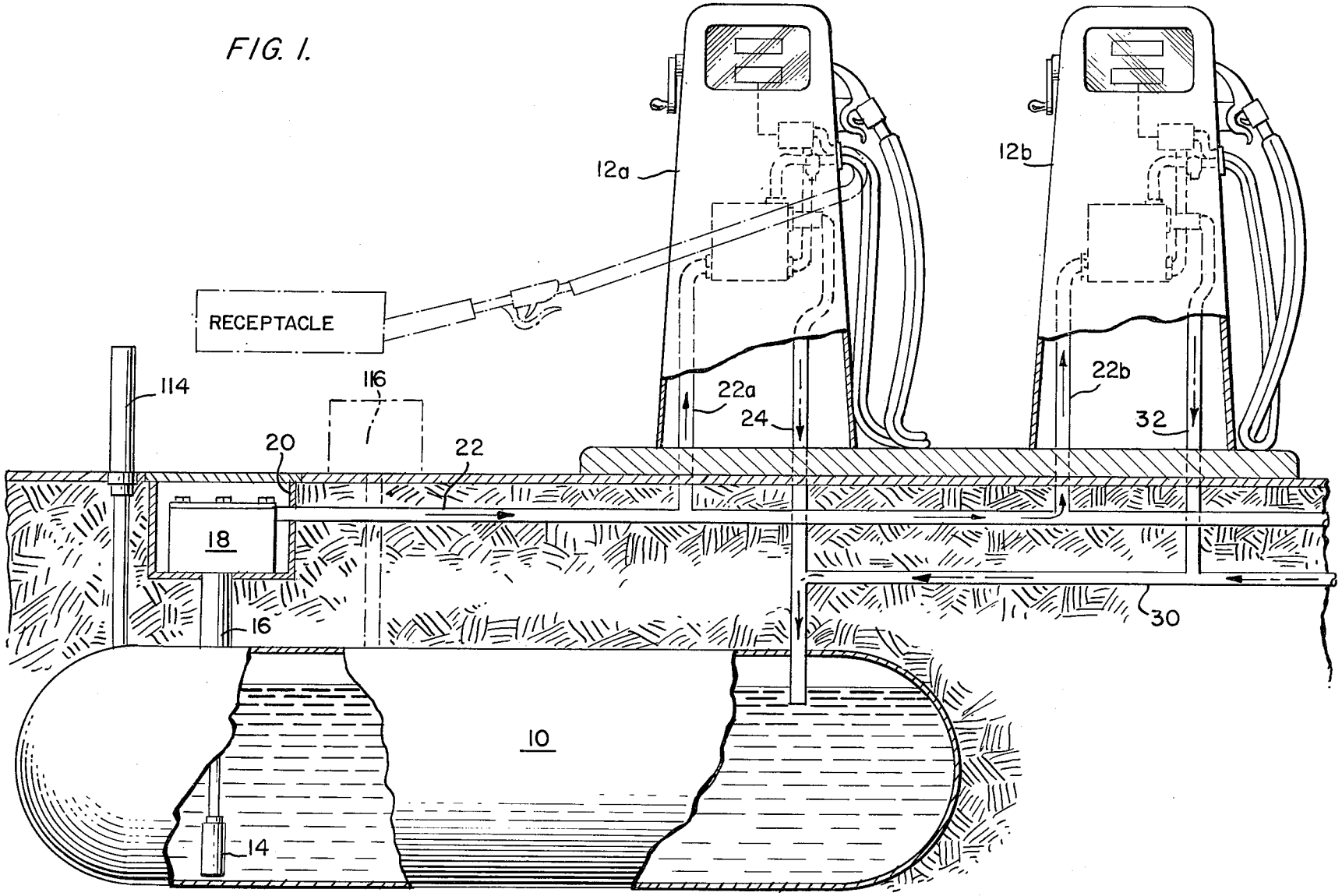
FIG. 1 is a partial schematic, partial elevational view of a service station installation having the dispensing and vapor recovery system of the present invention utilized therein.

As an example of the use of the liquid dispensing and vapor recovery system and the control unit of the present invention, they will be described in connection with a gasoline dispensing installation for use in service stations or the like. Such an installation is illustrated in FIG. 1 and includes an underground tank 10 for storing a quantity of gasoline which is delivered to two dispensing units, or pedestals, 12*a* and 12*b*. An electrically operated, centrifugal type submersible pump 14 is disposed in the tank and operates to draw the gasoline into the unit through a plurality of intake ports disposed at the bottom thereof, and to force the gasoline upwardly around a sealed electrical drive motor.

A casing 16 is attached to the tank 10 and extends upwardly therefrom to connect the outlet of the pump 14 to a discharge head, or manifold, 18 which is preferably disposed below ground level in a well 20. Since the manifold 18 is described in detail in U.S. Pat. No. 3,183,723, its structural details are not shown in the drawings, it being understood that it supports the upper portion of the pump unit 14 while permitting the electrical connections for the drive motor to be brought outwardly for connection to the proper controls. It is also understood that an adapter unit, or packer, is supported within the housing of the manifold 18 and has an inlet chamber communicating with the outlet of the pump 14 and an outlet chamber adapted for registration with a substantially horizontal main conduit 22. The packer also defines a port between the inlet chamber and the outlet chamber which cooperates with a check valve to permit the flow of gasoline from the pump 14 to the conduit 22 while preventing flow in the opposite direction, also in a conventional manner.

A pair of substantially vertical branch conduits 22*a* and 22*b* connect the main conduit 22 to the pedestals 12*a* and 12*b*, respectively, for delivering the gasoline to the pedestals.

A substantially vertical vapor recovery conduit 24 extends from the pedestal 12*a* into the tank 10 and terminates in the upper portion of the tank. A horizontal vapor recovery conduit 30 is connected to the conduit 24 and to a substantially vertical conduit 32 extending from the pedestal 12*b*, so that vapor from the latter pedestal is introduced into the conduit 24 for passage into the tank 10. It is noted from the drawings that in installations having more than two pedestals, the conduits 22 and 30 can be extended to connect with other vertical conduits of the additional pedestals.

Figure 2:
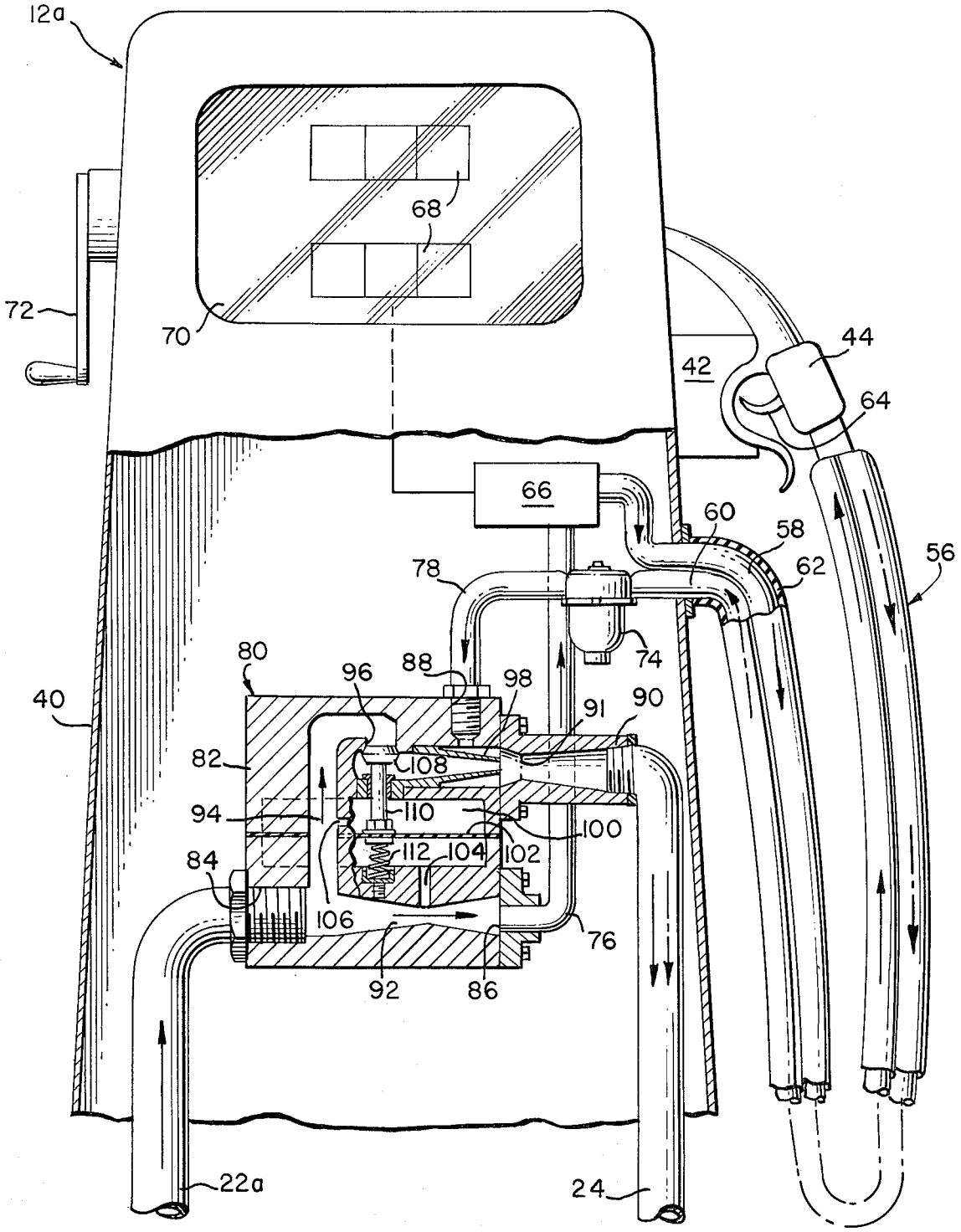
FIG. 2 is an enlarged, partial sectional, partial elevational view of a portion of dispensing unit utilized in the installation of FIG. 1, and incorporating the control unit of the present invention.

FIG. 2 depicts the details of pedestal 12*a*, it being understood that pedestals 12*b* is constructed in an identical manner. In particular, the pedestal 12*a* consists of a housing 40 having a support and switch assembly 42 supported on its upper outer surface which is adapted to support a dispensing unit 44. Although not shown in the drawings, it is understood that the assembly 42 includes a switch which operates to actuate the pump unit 14 in a conventional manner. The dispensing unit 44 is connected to one end of a hose assembly 56, with the other end portion of the latter assembly extending through and into the housing 40. The hose assembly 56 includes a pair of juxtapositioned hoses 58 and 60 surrounded by a protective cover 62. It is understood that the dispensing unit 44 includes a gasoline dispensing nozzle connected to the hose 58 and a vapor recovery conduit connected to the hose 60. The dispensing unit 44 is operated by a manually operated valve 64 in a conventional manner to dispense gasoline into the vehicle tank in which it is inserted.

In the interior of the housing 40, the hose 58 is connected to the outlet of a meter 66 which is mechanically connected to a pair of registers 68 disposed behind a window 70 in the pedestal housing 40. The registers 68 are operated by a crank 72 and are adapted to display the quantity and cost of the gasoline dispensed. Since the meter 66 and the registers 68 are of a conventional design, they are not shown, nor will be described, in any further detail.

The end of the hose 60 extending into the housing 40 is connected to a trap unit 74 for separating any solid materials from the vapor passing through the hose, also in a conventional manner.

The inlet of the meter 66 and the outlet of the trap unit 74 are connected, via conduits 76 and 78, respectively, to a control unit shown in general by the reference numeral 80. The control unit 80 consists of a housing 82 having an inlet 84 which is connected to the gasoline conduit 22*a* and an outlet 86 for the gasoline which is connected to the conduit 76. Also, the housing 82 has an additional inlet 88 which is connected to the conduit 78 for receiving vapors from the trap unit 74 and an outlet connection 90 which is connected to the conduit 24 for passing the vapors back into the storage tank 10. A venturi passage 91 is formed in the outlet connection 90 for reasons that will be described later.

A venturi passage 92 is also formed in the housing 82 and is connected between the inlet 84 and the outlet 86 for passing the gasoline directly between the conduits 22*a* and 76, respectively. A passage 94 is provided in the housing 82 in registery with the passage 92 for diverting a portion of the gasoline flow through the latter passage. The passage 94 has a vertical portion and a substantially U-shaped portion which terminates in an outlet port 96. An injector nozzle 98 is provided in the housing 82 in registery with the outlet port 96 and with the venturi passage 91 in the outlet connection 90. Thus the passage 94, the outlet port 96, the nozzle 98, and the passage 91 together form a continuous passage for the flow of the diverted gasoline from the passage 92 to the outlet connection 90.

A chamber 100 is defined in the housing 82 and is divided into an upper and lower portion by a flexible membrane 102 which is supported along its edge portions between adjacent surfaces of the housing 82. A passage 104 connects the lower portion of the chamber 100 to the venturi passage 92 and a passage 106 connects the upper portion of the chamber to the passage 94.

A poppet-like valve 108 having a tapered cross-section cooperates with the outlet port 96 to control the flow of fluid exiting from the passage 94 and passing into the injector nozzle 98. A rod 110 extends from the valve 108 and is connected by suitable nuts, or the like, to the membrane 102. A spring 112 extends between an interior surface in the housing and the membrane 102 immediately below the rod 110 to urge the rod, and therefore the valve 108, into a flow preventing position relative to the port 96.

In operation, upon an operator releasing the dispensing unit 44 from its support and switch assembly 42 on the housing 40 of pedestal 12*a*, for example, and actuating the associated switch, the pump 14 will be actuated to pump gasoline from the tank 10 through the manifold 18 and the conduits 22 and 22*a*. The gasoline flow through the conduit 22*a* will pass into the inlet 84 of the control unit 80, where it will pass through the venturi passage 92 and exit from the outlet 86 into and through the conduit 76. As a result of the gasoline passing through the venturi passage 92, a low pressure zone is created, which is transferred, via the passage 104, to the lower portion of the chamber 100. The gasoline then passes, from the conduit 76, through the meter 66 and the hose 58 to the dispensing unit 44, as shown by the solid arrows, for introduction into a vehicle gasoline tank.

A portion of the gasoline flowing into the venturi passage 92 will be diverted into the passage 94 for passage to the port 96. A portion of the gasoline flowing through the passage 94 passes into the upper portion of the chamber 100 via the passage 106.

If the differential pressure across the membrane 102 by virtue of the positive pressure applied to the upper portion of the chamber 100, via the passage 106, and the negative pressure applied to the lower portion of the chamber 100, via the passage 104, is of sufficient magnitude, the membrane 102 and therefore the rod 110 and the valve 108 will be urged downwardly against the force of the spring 112 to expose a portion of the port 96. As a result, the gasoline will flow from the passage 94, through the port 96, the injector nozzle 98 and the outlet connection 90 before passing into the conduit 24 and back to the tank 10.

As a result of the gasoline passing through the injector nozzle 98 and the venturi passage 91, a reduced pressure zone will be formed in the latter passage which is transferred, via the inlet 88, the conduit 78, and the trap unit 74, to the hose 60. This reduced pressure zone, plus the force of the gasoline as it displaces the vapors from the vehicle tank, will cause the vapors to pass from the vehicle tank into and through the corresponding conduit in the dispensing unit 44, the hose 60 and the trap unit 74, where it passes through the conduit 78 and the inlet 88 into the passage 91 as shown by the dashed arrows. In the passage 91, the vapors combine with the gasoline passing through this passage, with the resulting mixture passing, via the outlet connection 90 and the line 24, into the tank 10. The vapors are at least partially absorbed by the gasoline passing through the outlet connection 90 and the line 24, and those vapors not absorbed either condense in the tank 10 or are recovered by the gasoline transport truck in the manner discussed above.

Any change in the flow rate of the gasoline passing through the passage 92 will be accompanied by a corresponding change in the position of the valve 108 relative to the outlet port 96. As a result, the flow through the nozzle 98 and the passage 91, and the corresponding amount of vapor drawn into the control unit 80 is modulated in proportion to the gasoline flow through the unit. This enables a precise control of the vapor recovery to be achieved, thus permitting the units to be used in installations of varying capacity. Also, this is achieved while eliminating the possibility of pressurizing the storage tank or damaging the vehicle tank by virtue of a too high negative pressure occurring.

It is noted from FIG. 1 that the storage tank 10 is provided with a vent pipe 114 for exhausting vapor from the tank which may form due to diurnal losses and that an optional condenser system 116 may be provided which is connected to the tank 10, via a line 118, and which is adapted to condense any excessive vapors in the tank 10. Since this type of condenser system is well known in the art, it will not be described in any further detail.

It is thus seen that the present invention provides an effective and safe means of recovering vapors in a vehicle tank while minimizing the pollution of the atmosphere. It is emphasized that the system and control unit of the present invention is not limited to the dispensing of gasoline and the recovery of gasoline vapors but could be applied to any installation, such as chemical plants or the like, in which vapor recovery is desired.

Of course, other variations of the specific construction and arrangement of the system disclosed above can be made by those skilled in the art without departing from the invention as defined in the appended claims.

We claim:

1. A control unit for use in a liquid dispensing and vapor recovery system, said unit comprising a housing having first and second inlets for receiving liquid and vapor, respectively, and first and second outlets for discharging liquid and a mixture of liquid and vapor, respectively, first passage means in said housing connecting said liquid inlet and said liquid outlet, second passage means in said housing for diverting a portion of said liquid from said first passage means, said second passage means registering with said second inlet and said second outlet, means disposed in said second passage means for continuously changing the flow rate of liquid through said second passage means in proportion to changes in the flow rate of liquid through said first passage means, and means for drawing vapor through said second inlet and into said second passage means in proportion to the flow of liquid through said second passage means, said liquid and said vapor combining in said second passage means and discharging from said second outlet.

2. The unit of claim 1, wherein said means for drawing vapor and said means for continuously changing the flow rate of liquid are disposed in said housing.

3. The unit of claim 1, wherein said means for continuously changing the flow rate of liquid comprises a valve responsive to the flow rate of liquid in said first passage means.

4. The unit of claim 1, wherein said means for continuously changing the flow rate of liquid comprises a valve disposed in said second passage means, a chamber in said housing, a membrane disposed in said chamber and connected to said valve, said first passage means including a venturi portion in communication with said chamber for creating a negative pressure in said chamber to move said membrane and therefore said valve.

5. The unit of claim 1, wherein said means for drawing vapor comprises a nozzle and a venturi defined in said second passage means.

6. The unit of claim 1, wherein said second passage means is in open communication with said first passage means for continuously diverting a portion of said liquid from said first passage means.

7. A liquid dispensing and vapor recovery system comprising storage means for said liquid; a control unit having first and second inlets for receiving liquid and vapor, respectively, and first and second outlets for discharging liquid and a mixture of liquid and vapor, respectively; and conduit means connecting said storage means to said first inlet and to said second outlet, and connecting a receptacle to said first outlet and to said second inlet; said control unit comprising first passage means connecting said liquid inlet and said liquid outlet, second passage means for diverting a portion of said liquid from said first passage means, said second passage means registering with said second inlet and said second outlet; means disposed in said second passage means for continuously changing the flow rate of liquid through said second passage means in proportion to changes in the flow rate of liquid through said first passage means, and means for drawing vapor through said second inlet and into said second passage means in proportion to the flow of liquid through said second passage means, said liquid and said vapor combining in said second passage means and discharging from said second outlet.

8. The system of claim 7, wherein said means for drawing vapor and said means for continuously changing the flow rate of liquid are disposed in said housing.

9. The system of claim 7, wherein said means for continuously changing the flow rate of liquid comprises a valve responsive to the flow rate of liquid in said first passage means.

10. The system of claim 7, wherein said means for continuously changing the flow rate of liquid comprises a valve disposed in said second passage means, a chamber in said housing, a membrane disposed in said chamber and connected to said valve, said first passage means including a venturi portion in communication with said chamber for creating a negative pressure in said chamber to move said membrane and therefore said valve.

11. The system of claim 7, wherein said means for drawing vapor comprises a nozzle and a venturi defined in said second passage means.

12. The system of claim 7, wherein said second passage means is in open communication with said first passage means for continuously diverting a portion of said liquid from said first passage means.

13. The system of claim 7, further comprising a dispensing unit defining a portion of said conduit means, another portion of said conduit means being in the form of a hose connecting said dispensing unit to said first outlet and a hose connecting said dispensing unit to said second inlet.

* * * * *